US010444673B2

(12) United States Patent
Shindo et al.

(10) Patent No.: US 10,444,673 B2
(45) Date of Patent: Oct. 15, 2019

(54) GUIDE MEMBER AND IMAGE FORMING APPARATUS COMPRISING THE SAME

(71) Applicant: CANON KABUSHIKI KAISHA, Tokyo (JP)

(72) Inventors: Kenji Shindo, Yokohama (JP); Shinsuke Kobayashi, Yokohama (JP); Takaaki Akamatsu, Yokohama (JP); Kohei Okayasu, Mishima (JP); Takehiko Suzuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/191,274

(22) Filed: Nov. 14, 2018

(65) Prior Publication Data

US 2019/0079434 A1 Mar. 14, 2019

Related U.S. Application Data

(63) Continuation of application No. 15/719,248, filed on Sep. 28, 2017, now abandoned.

(30) Foreign Application Priority Data

Sep. 30, 2016 (JP) ..... 2016-192723

(51) Int. Cl.
*G03G 15/16* (2006.01)
*G03G 15/00* (2006.01)

(52) U.S. Cl.
CPC ..... *G03G 15/169* (2013.01); *G03G 15/1675* (2013.01); *G03G 15/1695* (2013.01); *G03G 15/6529* (2013.01); *G03G 15/6558* (2013.01); *G03G 15/80* (2013.01)

(58) Field of Classification Search
CPC ... G03G 15/169; G03G 15/6529; G03G 15/80
See application file for complete search history.

(56) References Cited

U.S. PATENT DOCUMENTS 6,205,300 B1 * 3/2001 Sakai ..... G03G 15/165 399/315
6,240,269 B1 * 5/2001 Kaya ..... G03G 13/04 399/127
2016/0062259 A1 * 3/2016 Miyagawa ..... G03G 15/0233 399/176
2017/0343918 A1 * 11/2017 Okayasu ..... G03G 15/235

OTHER PUBLICATIONS

Figures & machine translation of abstract of reference Takeda (JP 02-272,584 A) Pub Date Nov. 7, 1990 (Year: 1990).*

* cited by examiner

*Primary Examiner* — Rodney A Bonnette
(74) *Attorney, Agent, or Firm* — Canon U.S.A., Inc. IP Division

(57) ABSTRACT

There is provided an image forming apparatus including a configuration in which a voltage of a polarity opposite to a toner charging polarity is applied. In the image forming apparatus, a guide region of a pre-transfer guide is located on a photosensitive drum side with respect to a common tangent line of a photosensitive drum and a development roller to reduce contamination of the pre-transfer guide and prevent contamination of recording materials.

8 Claims, 8 Drawing Sheets

GUIDE MEMBER AND IMAGE FORMING APPARATUS COMPRISING THE SAME

CROSS REFERENCE TO RELATED APPLICATIONS

The present application is a continuation of U.S. patent application Ser. No. 15/719,248, filed on Sep. 28, 2017, which claims priority from Japanese Patent Application No. 2016-192723, filed Sep. 30, 2016, all of which are hereby incorporated by reference herein in their entireties.

BACKGROUND OF THE INVENTION

Field of the Invention

The present disclosure relates to electrophotographic image forming apparatuses such as copying machines, printers, facsimile apparatuses, and multi-function peripherals configured to form images using an electrophotographic technique.

Description of the Related Art

In an electrophotographic image forming apparatus, a photosensitive member is uniformly charged and then exposed to light generated according to image information to form an electrostatic latent image on the photosensitive member. The electrostatic latent image is developed with toner to form a toner image, and the toner image is transferred onto a recording material such as a recording sheet by a transfer member. Thereafter, the toner image transferred on the recording material is heated and fixed to the recording material by a fixing device.

In order to convey the recording material to a transfer area formed by the transfer member and the photosensitive member, a guide member configured to guide the orientation of recording materials is disposed upstream of the transfer area in the direction in which the recording materials are conveyed. Image forming apparatuses including such a guide member have been known. Japanese Patent Application Laid-Open No. 7-239617 discusses an image forming apparatus which includes a conveyance guide as the guide member and in which a voltage of a polarity opposite to a toner charging polarity is applied to the conveyance guide. The application of the voltage of the polarity opposite to the toner charging polarity to the conveyance guide prevents leakage of transfer current from a transfer member through a recording material.

However, in a configuration in which the voltage of the polarity opposite to the toner charging polarity is applied to the conveyance guide, normal-polarity toner scattered from a development device may adhere to the conveyance guide. An increase in the amount of toner adhering to the conveyance guide may lead to contamination of recording materials that pass through the conveyance guide.

SUMMARY OF THE INVENTION

The present disclosure is directed to a technique for preventing accumulation of toner on a guide member in a configuration in which a voltage of a polarity opposite to a toner charging polarity is applied to the guide member.

According to an aspect of the present disclosure, an image forming apparatus includes a photosensitive member on which an electrostatic latent image is to be formed, a charging member configured to charge the photosensitive member, a developing member configured to develop the electrostatic latent image formed on the photosensitive member with toner charged to a predetermined polarity, a transfer member configured to form a transfer area with the photosensitive member and transfer a toner image from the photosensitive member onto a recording material in the transfer area, a transfer power source configured to apply a voltage of a polarity opposite to the predetermined polarity to the transfer member, a guide member located upstream of the transfer area in a direction in which the recording material is conveyed, and configured to come into contact with a back surface of the conveyed recording material to guide the recording material, and an auxiliary power source configured to apply the voltage of the opposite polarity to the guide member, wherein the guide member includes a guide region configured to contact the back surface of the recording material, and the guide region is entirely located on the photosensitive member side of a common imaginary tangent line in a developing area formed by the photosensitive member and the developing member.

Further features of the present disclosure will become apparent from the following description of exemplary embodiments with reference to the attached drawings.

DESCRIPTION OF THE EMBODIMENTS

Various exemplary embodiments of the invention will be described in detail below with reference to the drawings. It should be noted that the sizes, materials, shapes, relative positions, etc. of components described in the exemplary embodiments are to be changed as appropriate according to various conditions and configurations of an apparatus to which the disclosure is applied, and the scope of the disclosure is not limited to the exemplary embodiments described below.

Figure 2:
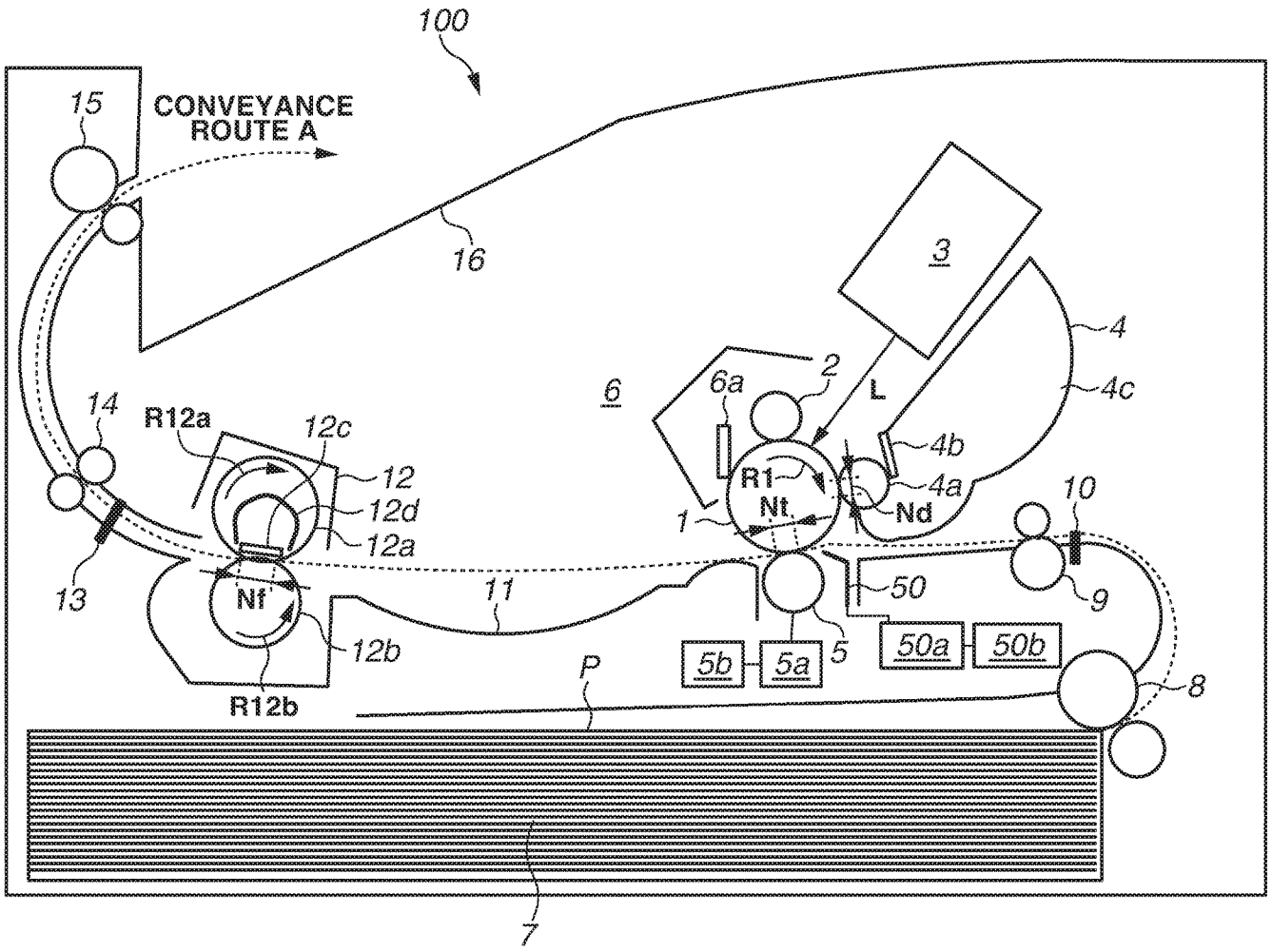
FIG. 2 is a cross-sectional view schematically illustrating an image forming apparatus according to the first exemplary embodiment.

FIG. 2 illustrates an image forming apparatus 100 according to a first exemplary embodiment, which is an electrophotographic laser beam printer. FIG. 2 is a cross-sectional view schematically illustrating the image forming apparatus 100 according to the present exemplary embodiment. The image forming apparatus 100 includes a drum-type electrophotographic photosensitive member 1 (hereinafter, "photosensitive drum 1") as an image bearing member. The photosensitive drum 1 includes a cylindrical drum substrate made of aluminum or nickel and a photosensitive material, such as an organic photoconductor (OPC), amorphous selenium, or amorphous silicon, formed on the drum substrate. The photosensitive drum 1 is rotatably supported by the image forming apparatus 100 and is driven to rotate by a driving source (not illustrated) at a predetermined processing speed in the direction of an arrow R1.

Around the photosensitive drum 1 are disposed a charging member (charging roller) 2, an exposure unit 3, a development unit 4, a transfer unit (transfer roller) 5, and a cleaning unit 6 in this order in the direction in which the photosensitive drum 1 is rotated. Further, a sheet feeding cassette 7 in which recording materials P such as sheets are stored is disposed in a lower portion of the image forming apparatus 100. Further, a sheet feeding roller 8, a pair of conveying rollers 9, a top sensor 10, a pre-transfer guide 50, which is a first guide member, and a post-transfer guide 11, which is a second guide member, are disposed in this order along a path along which the recording materials P are conveyed. Further, a fixing device 12, a sheet discharge sensor 13, a conveying roller 14, a sheet discharge roller 15, and a sheet discharge tray 16 are disposed.

The following describes an image forming process performed by the image forming apparatus 100 configured as described above. The photosensitive drum 1 driven to rotate by the driving source (not illustrated) in the direction of the arrow R1 is uniformly charged to a predetermined polarity and a predetermined potential (Vd: −500 V) by the charging roller 2. The surface of the charged photosensitive drum 1 is exposed by the exposure unit 3 with image exposure light L generated based on image information, and charges of the exposed portion are removed to form an electrostatic latent image (VL: −100 V). The electrostatic latent image is developed by the development unit 4. The development unit 4 includes a development roller 4*a*, which is a developing member, a development blade 4*b*, and a toner container 4*c*. Toner T in the toner container 4*c* is supplied to the development roller 4*a*, conveyed to the position of the development blade 4*b* by the rotation of the development roller 4*a*, and passed through the development blade 4*b* to form a uniform toner coat on the development roller 4*a*. The toner T is charged to the predetermined polarity. In the present exemplary embodiment, the toner T is negatively charged. While being driven with a predetermined difference in peripheral speed from the photosensitive drum 1, the development roller 4*a* contacts the photosensitive drum 1 to form a developing area Nd. Further, a development bias (−300 V) is applied by a development high-voltage power source (not illustrated) to develop the electrostatic latent image on the photosensitive drum 1 to form a toner image.

The toner image is transferred onto a recording material P by the transfer roller 5. The transfer roller 5 is pressed against the photosensitive drum 1 by a transfer pressurizing spring (not illustrated) to form a transfer area Nt between the transfer roller 5 and the photosensitive drum 1. The recording materials P are stored in the sheet feeding cassette 7, fed one by one by the sheet feeding roller 8, conveyed by the pair of conveying rollers 9, and conveyed along a conveyance route A. While being guided by the pre-transfer guide 50, the recording material P is conveyed to the transfer area Nt formed between the photosensitive drum 1 and the transfer roller 5. At this time, the leading edge of the recording material P is detected by the top sensor 10 and is synchronized with the toner image formed on the photosensitive drum 1. A transfer voltage of a polarity (in the present exemplary embodiment, positive polarity) opposite to a toner charging polarity is applied to the transfer roller 5 by a transfer voltage source 5*a* to transfer the toner image formed on the photosensitive drum 1 onto a predetermined position on the recording material P. The voltage applied by the transfer voltage source 5*a* is controlled by a transfer control unit 5*b*.

Figure 3:
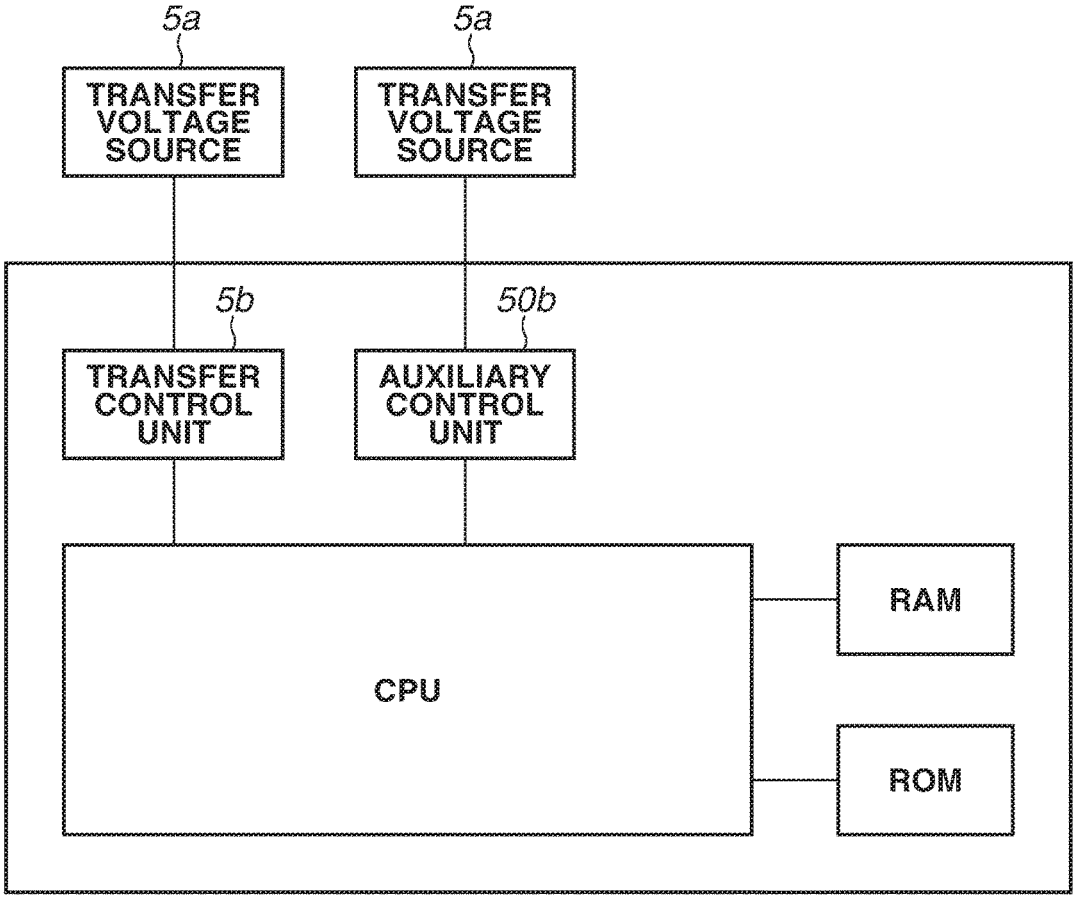
FIG. 3 is a block diagram illustrating a control unit according to the first exemplary embodiment.

FIG. 3 is a block diagram illustrating a control unit 110 configured to perform various types of control according to the present exemplary embodiment. The control unit 110 includes a central processing unit (CPU), a random access memory (RAM), and a read-only memory (ROM) and performs control for forming images while controlling various power sources according to programs stored in the ROM. Further, the control unit 110 includes the transfer control unit 5*b* (first control unit) configured to control the transfer voltage source 5*a* (first power source) and an auxiliary control unit 50*b* (second control unit) configured to control an auxiliary power source 50*a* (second power source). The transfer voltage source 5*a* and the auxiliary power source 50*a* are controllable by the control unit 110.

Further, a cleaning blade 6*a* is included in the cleaning unit 6 to scrape the toner slightly remaining on the photosensitive drum 1 after the transfer so that the photosensitive drum 1 is ready for the next image forming operation.

The recording material P bearing the transferred unfixed toner image on a surface thereof is conveyed along the post-transfer guide 11 to the fixing device 12, and the unfixed toner image is heated and pressed at the fixing device 12 to be fixed onto the surface of the recording material P. The fixing device 12 employs a pressing roller driving method using a flexible endless belt as a fixing film. The fixing device 12 includes a fixing film 12*a* and a pressing roller 12*b*. The fixing film 12*a* is a film-shaped rotary fixing member. The pressing roller 12*b* is a pressing member which is in contact with the fixing film 12*a*. The fixing device 12 includes a ceramic heater (hereinafter, "heater") 12*c* and a heater holder 12*d* as main components. The heater 12*c* heats the toner via the fixing film 12*a*. The heater holder 12*d* is a heater support member.

The pressing roller 12*b* includes a metal core, a heat-resistant elastic layer, such as a silicone rubber, provided on the outer surface of the metal core, and a release layer as the outermost layer made of a material having high releasability, such as fluororesin. The outer surface of the release layer of the pressing roller 12*b* presses the fixing film 12*a* upward against the heater 12*c* with a pressurizing spring (not illustrated) to form a fixing nip area Nf between the pressing roller 12*b* and the fixing film 12*a*. The pressing roller 12*b* is driven to rotate by a driving source (not illustrated) in the direction of an arrow R12*b* to rotate the fixing film 12*a* in the direction of an arrow R12*a* while the inner surface of the fixing film 12*a* and the downward surface of the heater 12*c* slide against each other in close contact.

In this state, while the temperature of the heater 12*c* is increased to a predetermined temperature and is under temperature adjustment, the recording material P bearing the unfixed toner image is introduced, nipped, and conveyed between the fixing nip area Nf formed by the fixing film 12*a* and the pressing roller 12*b*. During this nipping and conveying process, the heat of the heater 12*c* is applied to the recording material P through the fixing film 12*a* to heat and press the unfixed toner image on the recording material P so that the unfixed toner image is fused and fixed onto the recording material P. The recording material P having passed through the fixing nip area Nf is separated (curvature separation) from the fixing film 12*a*. The recording material P with the fixed toner image is conveyed by the conveying roller 14 and discharged onto the sheet discharge tray 16 on an upper surface of the main body of the image forming apparatus 100 by the sheet discharge roller 15.

Further, a plurality of components such as the photosensitive drum 1, the charging member 2, the cleaning unit 6, and the development unit 4 are integrated as a process cartridge, and the process cartridge is designed to be attachable to and detachable from the image forming apparatus 100 to enable easy replacement.

Figure 1:
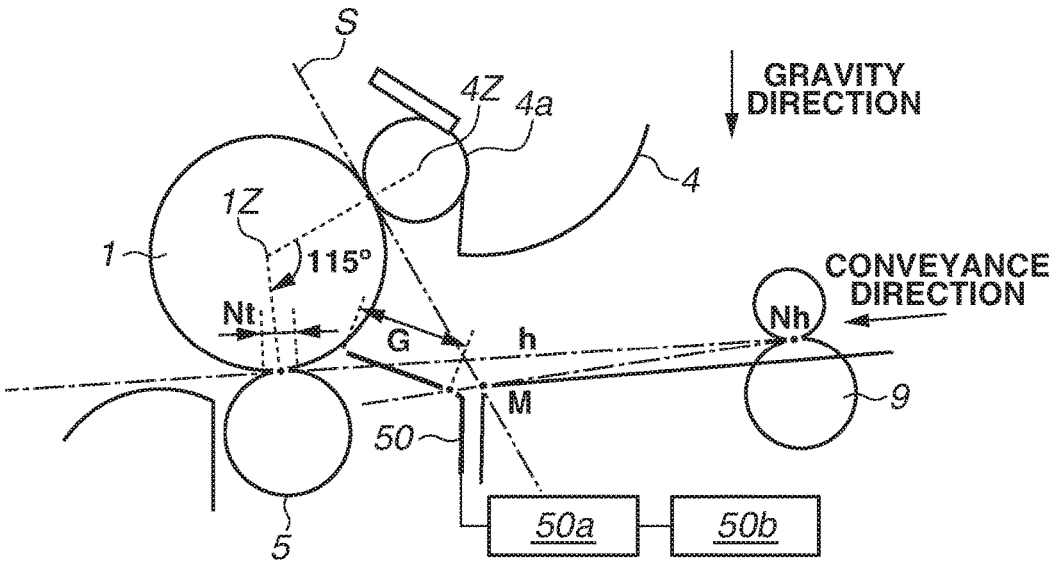
FIG. 1 schematically illustrates a location of a guide member according to a first exemplary embodiment.

In the present exemplary embodiment, the auxiliary power source 50*a* applies a voltage to the pre-transfer guide 50. This will be described below with reference to FIG. 1. FIG. 1 schematically illustrates the location of the pre-transfer guide 50. The auxiliary power source 50*a* applies a voltage of the polarity (in the present exemplary embodiment, positive polarity) opposite to the toner charging polarity to the pre-transfer guide 50. As illustrated in FIG. 1, in order to guide to the transfer area Nt the recording material P conveyed by the pair of conveying rollers 9, the pre-transfer guide 50 is disposed near the transfer area Nt and upstream of the direction in which the recording material P is conveyed. The back surface of the recording material P is in contact with the pre-transfer guide 50 so that the pre-transfer guide 50 guides the recording material P to the direction of movement.

Figure 6:
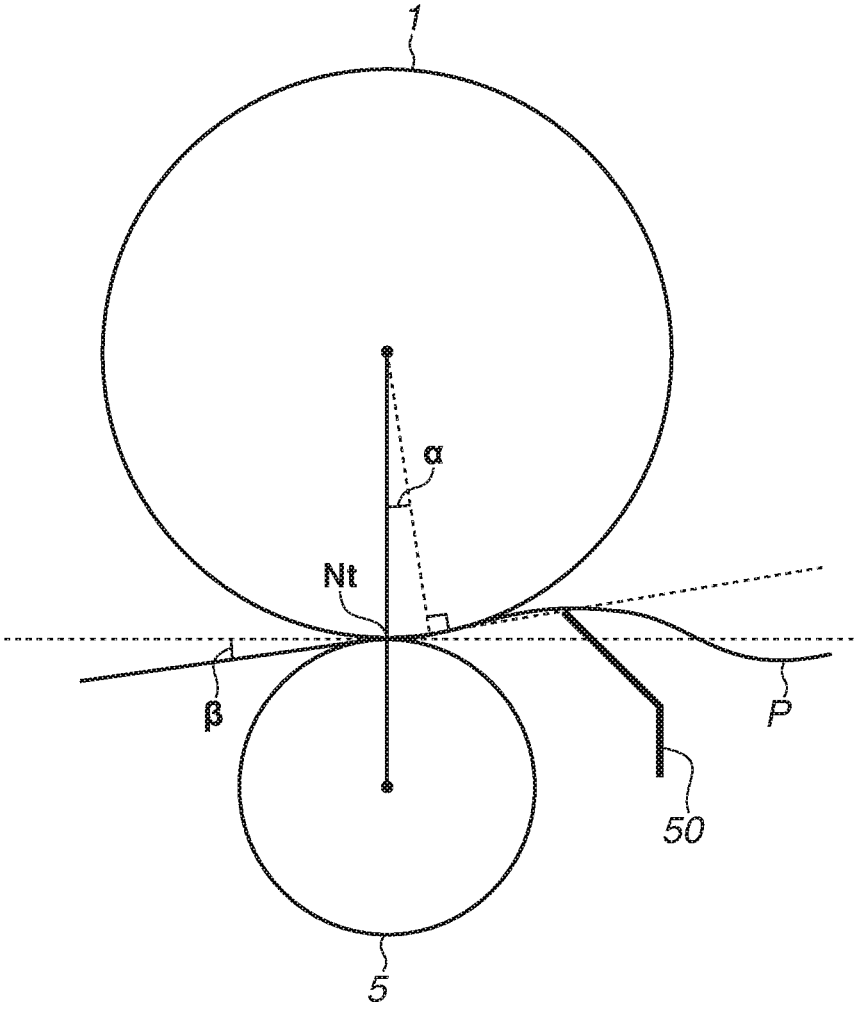
FIG. 6 schematically illustrates a movement locus of a recording material that is in contact with the guide member according to the first exemplary embodiment.

Further, the pre-transfer guide 50 is located in such a manner that a portion of the pre-transfer guide 50 extends toward the photosensitive member 1 from an imaginary line h connecting the transfer area Nt and a nip area Nh (conveyance nip area) of the pair of conveying rollers 9, so as to contact the recording material P. As illustrated in FIGS. 1 and 2, the recording material P comes into contact with the pre-transfer guide 50 so that the leading edge of the recording material P is guided to the direction of the photosensitive drum 1 and the recording material P is conveyed from the upstream side of the transfer area Nt along the photosensitive drum 1 to the transfer area Nt. FIG. 6 schematically illustrates the movement locus of the recording material P which is in contact with the pre-transfer guide 50. The recording material P in contact with the pre-transfer guide 50 is conveyed from the upstream side of the transfer area Nt to the transfer area Nt while being wound around the photosensitive drum 1. In this way, occurrence of electric discharge on the upstream side of the transfer area Nt is prevented, and an image scattering is reduced.

In order to prevent triboelectric charging which is caused by a frictional sliding against the recording material P, the pre-transfer guide 50 is entirely or partly made of a conductive material such as iron or stainless steel (SUS). In the case where a conductive material is used in the pre-transfer guide 50, when the recording material P arrives at the transfer area Nt, a current may flow from the transfer roller 5 through the recording material P to result in a decreased current (transfer current) flow to the photosensitive drum 1 side in the transfer area Nt. A decrease in transfer current leads to a decrease in transfer efficiency, and this phenomenon is likely to occur especially in the case where the resistance of the recording material P is low. Thus, in the present exemplary embodiment, the auxiliary power source 50*a* applies a voltage of positive polarity to the pre-transfer guide 50 to prevent leakage of the current from the transfer roller 5 through the recording material P.

An optimum voltage value to be applied from the auxiliary power source 50*a* to the pre-transfer guide 50 varies depending on charging properties of the toner and latent image settings of the photosensitive drum 1. In the present exemplary embodiment, a voltage in the range of 300 to 500 V with the same polarity as that of the voltage applied by the transfer voltage source 5*a* and with a small absolute value can be applied, and thus a voltage of 300 V is applied. As described above, in the present exemplary embodiment, a voltage is applied to the pre-transfer guide 50 to prevent occurrence of current leakage and realize favorable transfer efficiency. The photosensitive drum 1 is uniformly charged by the charging roller 2 to a potential (Vd) of the predetermined polarity. In the present exemplary embodiment, the potential Vd is −500 V, which means that a potential difference of 800 V is generated between the pre-transfer guide 50 and the photosensitive drum 1.

Further, the pre-transfer guide 50 according to the present exemplary embodiment includes an effective region G on the photosensitive drum 1 side with respect to a common tangent line S (refer to FIG. 1) of the photosensitive drum 1 and the development roller 4*a*. The common tangent line S is an imaginary tangent line that is at a right angle to an imaginary line connecting an axial center 1*z* of the photosensitive drum 1 and an axial center 4*z* of the development roller 4*a* and passes through a developing area Nd. Further, the effective region G refers to a region (guide region) of the pre-transfer guide 50 that can come into contact with the recording material P and is on a side of the nip area Nh of the pair of conveying rollers 9. Further, the development transfer angle, which is a difference in phase angle between the developing area Nd and the transfer area Nt with respect to the central axis of the photosensitive drum 1, is 115 degrees.

If the potential on the photosensitive drum 1 is a post-charging potential (Vd), the toner remains on the development roller 4*a* in the developing area Nd. However, as a result of a repeated sheet feeding and change in the environment, the toner may deteriorate and may be scattered from the developing area Nd instead of being confined by the electric field of the development roller 4*a*. In general, a strong electric field is applied in the vicinity of the developing area Nd, so that the toner is pulled back to the photosensitive drum 1 or the development roller 4*a* according to the charge amount (triboelectricity) of the toner. However, weak triboelectric toner generated by deterioration in durability is less likely to be affected by the electric field and may float in a space of the image forming apparatus 100.

Most of the floating toner moves toward the downstream side in the direction of velocity of the common tangent line S of the photosensitive drum 1 and the development roller 4*a* due to inertia generated when the development roller 4*a* had been rotated.

Figure 4:
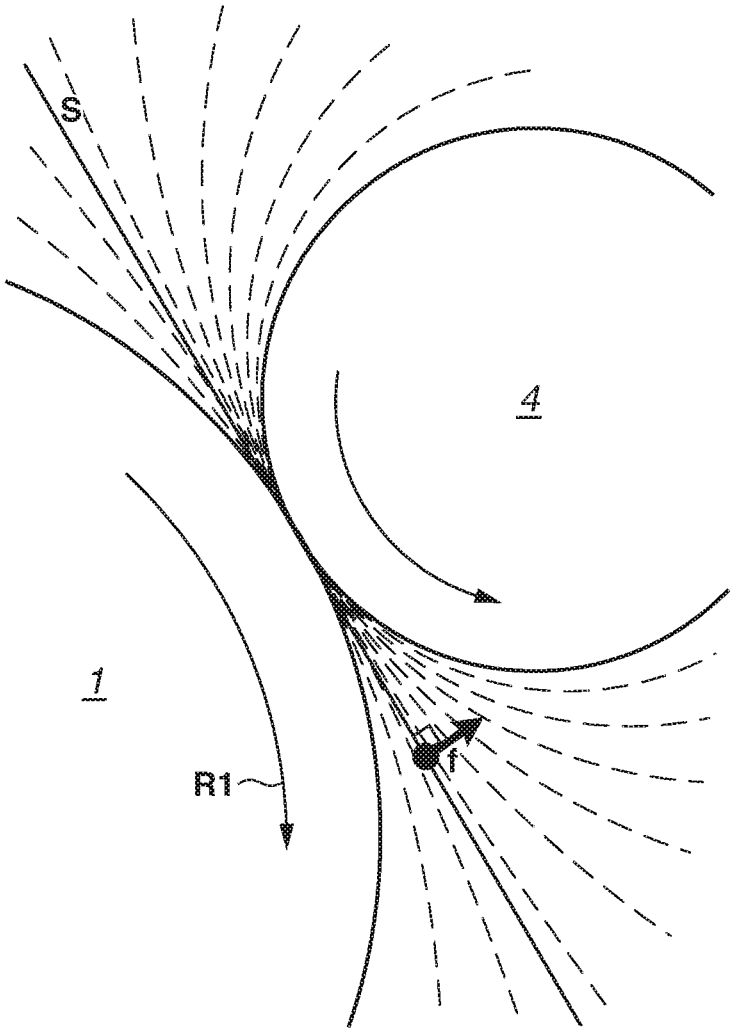
FIG. 4 schematically illustrates a potential relationship between a developing member and a photosensitive member according to the first exemplary embodiment.

FIG. 4 illustrates equipotential lines calculated by performing electric field calculation of an electric field generated between the development roller 4*a* and the photosensitive drum 1. The broken lines indicate the equipotential lines. The electric field generated between the photosensitive drum 1 and the development roller 4*a* is an electric field generated between two cylindrical objects, so that it is commonly known that equipotential surfaces are generated in the shape of circumscribed circles. Thus, weak negative toner which is a floating toner is weakly affected by the electric field in a substantially perpendicular direction to the common tangent line S to gradually float toward the development roller 4*a* side of the common tangent line S. Accordingly, the negative-polarity floating toner is distributed more on the development roller 4*a* side of the common tangent line S.

Thus, in the present exemplary embodiment, the location of the floating toner is arranged so that the floating toner does not adhere to the pre-transfer guide 50. Specifically, the effective region G of the pre-transfer guide 50 is entirely located on the photosensitive drum 1 side of the common tangent line S so that the floating toner is less likely to adhere to the pre-transfer guide 50 to reduce an accumulation of toner on the pre-transfer guide 50.

An advantage of the present exemplary embodiment was experimentally validated. In the validation of the advantage, letter-sized Xerox Business 4200 sheets (hereinafter, "letter sheets") were used as the recording materials P. Further, SUS was used as a material of the pre-transfer guide 50.

Figure 5:
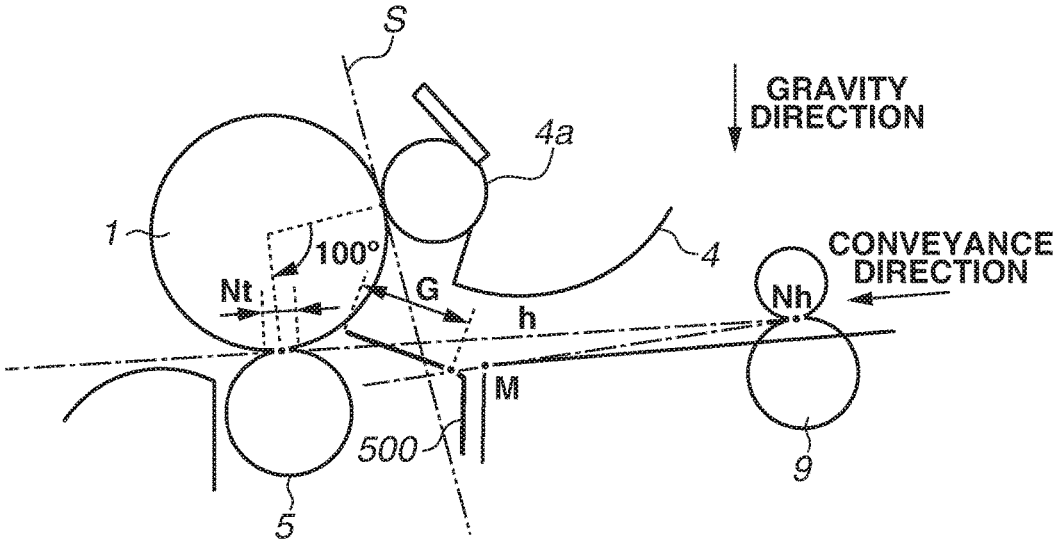
FIG. 5 schematically illustrates the location of a guide member according to a first comparative example.

The letter sheets that had been left under a high-temperature, high-humidity environment with a temperature of 32.5 degrees and a humidity of 80% for 48 hours were prepared as the recording materials P, and halftone (HT) images with a printing ratio of 4% were printed while 200 recording materials P were fed. At this time, a cartridge 80% of which had been used with respect to the lifetime of the cartridge was used. FIG. 5 illustrates a configuration according to a first comparative example which is different from the present exemplary embodiment in the locations of the pre-transfer guide 500 and the development roller 4*a*. In the configuration according to the first comparative example illustrated in FIG. 5, the development transfer angle, which is a difference in phase angle between the developing area Nd and the transfer area Nt with respect to the central axis of the photosensitive drum 1, is 100 degrees, and the effective region G of the pre-transfer guide 50 is located on the common tangent line S.

Contaminations of the pre-transfer guides according to the present exemplary embodiment and the first comparative example after the sheet feeding and contaminations of the recording materials caused by the contaminations of the pre-transfer guides were compared. In both the first exemplary embodiment and the first comparative example, the effective region G is located immediately below the developing area in the vertical direction (height direction), and the pre-transfer guide 50 and the developing area Nd directly face each other (no guide member configured to face the pre-transfer guide and guide a front surface of a recording material P is included).

In the first comparative example, the pre-transfer guide 500 protrudes toward the development unit 4 from the common tangent line S of the photosensitive drum 1 and the development roller 4*a*, so a portion of the pre-transfer guide 500 exists (extends) in a region where the floating toner is more likely to exist. Since the voltage of the polarity (positive polarity) opposite to the polarity of the floating toner is applied to the pre-transfer guide 500, the floating toner is attracted to the pre-transfer guide 500 and accumulated on the pre-transfer guide 500. Thus, the recording materials P were contaminated in the first comparative example. The larger the effective region G that extends from the common tangent line S toward the development roller 4*a* is, the more the toner is likely to be accumulated, and the contamination of the recording materials P is more likely to occur.

On the other hand, in the first exemplary embodiment, the effective region G is entirely located on the photosensitive drum 1 side of the common tangent line S to produce an advantage that contamination of the pre-transfer guide 50 is reduced to prevent contamination of the recording materials P.

In the first exemplary embodiment, the image forming apparatus 100 with the pre-transfer guide 50 located below the development unit 4 is described. A second exemplary embodiment is different from the first exemplary embodiment in that the pre-transfer guide 50 is located not below the development unit 4 (not immediately below the development nip area Nd) but in a shifted position from the development unit 4 in the horizontal direction. Further, an image forming apparatus 200 according to the second exemplary embodiment is an image forming apparatus that does not include the cleaning unit 6 according to the first exemplary embodiment and employs a drum-cleanerless method instead in which toner adhering to the photosensitive drum 1 is collected by the development unit 4. Further, the locations of the respective components in the second exemplary embodiment are different from those in the first exemplary embodiment, and thus the conveyance route of the recording materials P will be referred to as a conveyance route B in the second exemplary embodiment.

Figure 7:
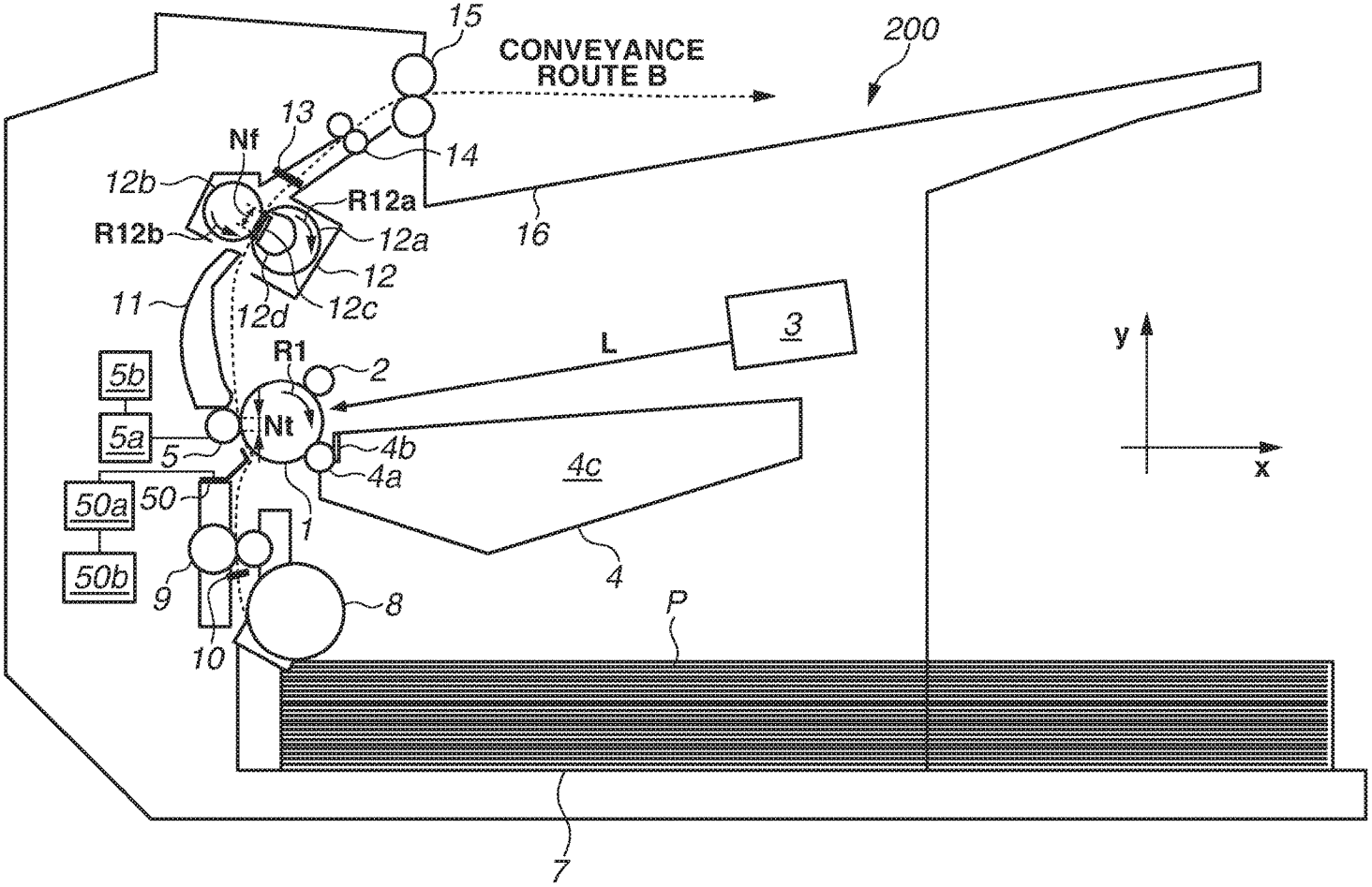
FIG. 7 is a cross-sectional view schematically illustrating an image forming apparatus according to a second exemplary embodiment.

FIG. 7 schematically illustrates the image forming apparatus 200 according to the second exemplary embodiment. The components and control of the image forming apparatus 200 are similar to those in the first exemplary embodiment and are given the same reference numerals. Thus description thereof is omitted. The image forming apparatus 200 includes the sheet feeding roller 8, the photosensitive drum 1, the pre-transfer guide 50, and the fixing device 12 in this order in a vertical direction y (height direction of the image forming apparatus 200). Thus, the recording material P that is fed by the sheet feeding roller 8 is conveyed in the vertical direction y and then brought into contact with the pre-transfer guide 50. The recording material P that has been brought into contact with the pre-transfer guide 50 is conveyed by the photosensitive drum 1 in the vertical direction y and arrives at the fixing device 12. The recording material P having arrived at the fixing device 12 is conveyed by the sheet discharge roller 15 in a horizontal direction x and discharged to the sheet discharge tray 16. This conveyance route B is employed so that the image forming apparatus 200 has a shorter conveyance route than the conveyance route in the image forming apparatus 100 according to the first exemplary embodiment and is thus suitable for size reduction.

Further, the image forming apparatus 200 according to the present exemplary embodiment is a drum-cleanerless image forming apparatus. Specifically, residual toner that is not transferred onto a recording material P and remains on the photosensitive drum 1 is moved from the photosensitive drum 1 to the development roller 4*a* by a potential difference formed between the photosensitive drum 1 and the development roller 4*a* of the development unit 4. In other words, the residual toner remaining on the photosensitive drum 1 is collected by the development roller 4*a* instead of by a dedicated cleaning member. Thus, the potential (Vd) of the photosensitive drum 1 charged by the charging roller 2 to the predetermined polarity is set to −800 V and the development bias applied by the development high-voltage power source (not illustrated) is set to −200 V so that the potential difference is larger than the potential difference in the first exemplary embodiment.

Figure 8:
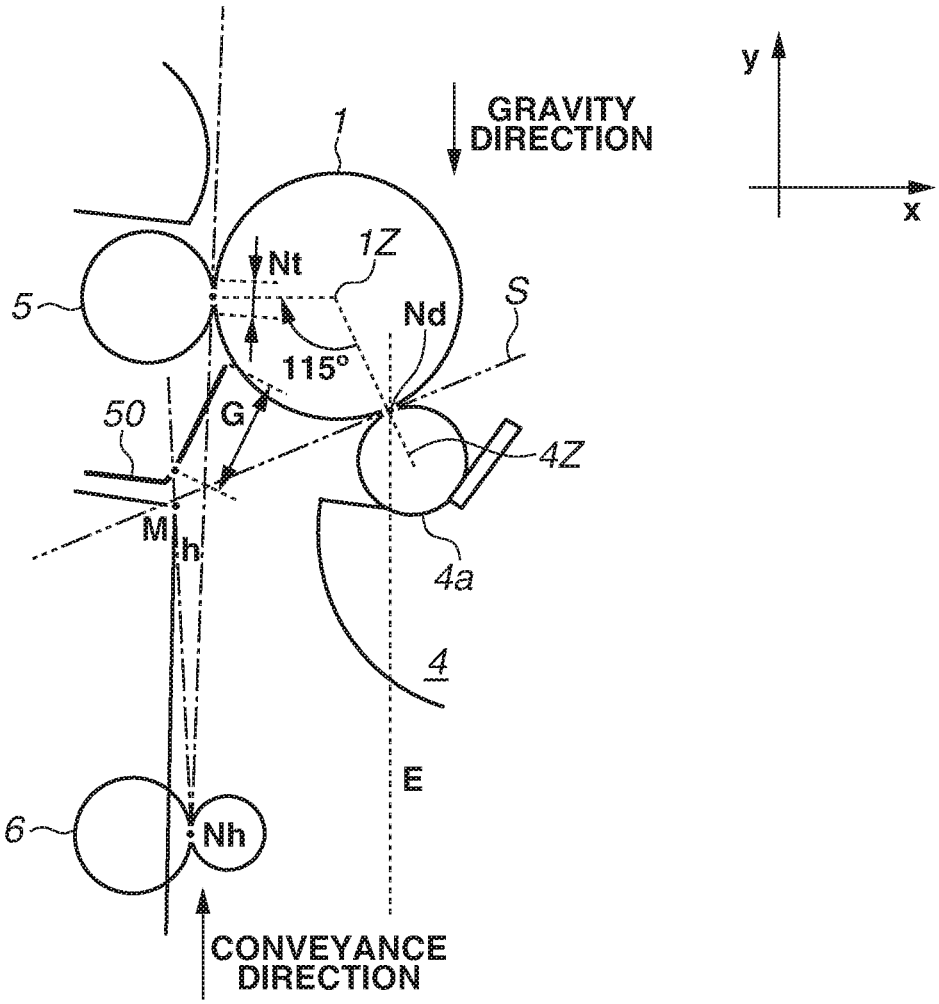
FIG. 8 schematically illustrates the location of a guide member according to the second exemplary embodiment.

FIG. 8 is an enlarged view schematically illustrating the vicinity of the transfer area Nt of the image forming apparatus 200 according to the second exemplary embodiment. In the second exemplary embodiment, as in the first exemplary embodiment, the pre-transfer guide 50 is located such that the effective region G of the pre-transfer guide 50 exists on the photosensitive drum 1 side of the common tangent line S. Further, the pre-transfer guide 50 is located remote from the development unit 4 in the horizontal direction x. Further, in the vertical direction y, the pre-transfer guide 50 is located on substantially the same level as the developing area Nd formed by the development roller 4*a* and the photosensitive drum 1.

In FIG. 8, a vertical line passing through the developing area Nd is specified as a vertical line E. As illustrated in FIG. 8, the pre-transfer guide 50 according to the present exemplary embodiment is located not to overlap the vertical line E.

In the case where the drum-cleanerless method is employed, the development bias is reduced to increase the potential difference as described above, so a larger amount of toner is likely to float than in the first exemplary embodiment. When the amount of floating toner increases, more floating toner is likely to adhere to the pre-transfer guide 50 to which the voltage of positive polarity is applied by the auxiliary power source 50*a*. However, since the pre-transfer guide 50 is located such that the effective region G of the pre-transfer guide 50 exists on the photosensitive drum 1 side of the common tangent line S, adhesion of floating toner to the pre-transfer guide 50 is prevented as in the first exemplary embodiment.

Further, the pre-transfer guide 50 is located remote from the development unit 4 in the horizontal direction x and on substantially the same level as the developing area Nd formed by the development roller 4*a* and the photosensitive drum 1 in the vertical direction y. This produces an advantage that adhesion of floating toner to the pre-transfer guide 50 is prevented using the force of gravity.

According to the exemplary embodiments of the present disclosure, adhesion of toner to the guide member is prevented by adjusting the positional relationship between the developing area and the guide member in the configuration in which the voltage of the polarity opposite to the toner charging polarity is applied to the guide member. This prevents recording materials from being contaminated by toner adhering to the guide member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. An image forming apparatus comprising:

a photosensitive member on which an electrostatic latent image is to be formed;

a charging member configured to charge the photosensitive member;

a developing member configured to develop the electrostatic latent image formed on the photosensitive member with toner charged to a predetermined polarity;

a transfer member configured to form a transfer area with the photosensitive member and transfer a toner image from the photosensitive member onto a recording material in the transfer area;

a first power source configured to apply a voltage of a polarity opposite to the predetermined polarity to the transfer member;

a guide member located upstream of the transfer area in a direction in which the recording material is conveyed, and configured to contact a back surface of the conveyed recording material to guide the recording material;

a second power source configured to apply the voltage of the polarity opposite to the predetermined polarity to the guide member; and a pair of conveying rollers located upstream of the guide member in the direction in which the recording material is conveyed, and configured to convey the recording material toward the transfer area, wherein the guide member includes a guide region configured to contact the back surface of the recording material, and the guide region is entirely located on a side of the photosensitive member of a common imaginary tangent line in a developing area formed by the photosensitive member and the developing member, and wherein at least a part of the guide member protrudes toward the developing member beyond an imaginary line at a conveyance nip area formed by the pair of conveying rollers.

2. The image forming apparatus according to claim 1, wherein the guide member is entirely located on the side of the photosensitive member of the common imaginary tangent line in the developing area.

3. The image forming apparatus according to claim 1, further comprising:

wherein at least a portion of the guide member extends toward the photosensitive member from the imaginary line connecting the conveyance nip area formed by the pair of conveying rollers and the transfer area.

4. The image forming apparatus according to claim 1, wherein the guide region of the guide member and the developing member face each other.

5. The image forming apparatus according to claim 1, wherein the guide member guides the recording material to the transfer area with the recording material wound around the photosensitive member.

6. The image forming apparatus according to claim 1, wherein the guide region of the guide member is located immediately below the developing area in a vertical direction.

7. The image forming apparatus according to claim 1, wherein the guide region of the guide member is located not immediately below the developing area in a vertical direction but in a shifted position from the developing area in a horizontal direction.

8. The image forming apparatus according to claim 7, wherein the developing member collects from the photosensitive member the toner which remains on the photosensitive member.

* * * * *